US008851327B2

(12) United States Patent
Maule

(10) Patent No.: US 8,851,327 B2
(45) Date of Patent: Oct. 7, 2014

(54) SUPPORT GROUP OF PRODUCTS DISTRIBUTABLE BY MEANS OF VENDING MACHINES AND SUPPLY DEVICE OF PRODUCTS USING SUCH A SUPPORT GROUP

(75) Inventor: Mauro Maule, Montebello Vicentino (IT)

(73) Assignee: Magex S.R.L., Montebello Vicentino (VC) (IT)

( * ) Notice: Subject to any disclaimer, the term of this patent is extended or adjusted under 35 U.S.C. 154(b) by 419 days.

(21) Appl. No.: 13/138,840

(22) PCT Filed: Mar. 30, 2010

(86) PCT No.: PCT/IT2010/000135
§ 371 (c)(1),
(2), (4) Date: Jan. 19, 2012

(87) PCT Pub. No.: WO2010/116395
PCT Pub. Date: Oct. 14, 2010

(65) Prior Publication Data

US 2012/0104018 A1 May 3, 2012

(30) Foreign Application Priority Data

Apr. 6, 2009 (IT) ..... VI2009A0079

(51) Int. Cl.
*G07F 11/00* (2006.01)
*G07F 11/58* (2006.01)

(52) U.S. Cl.
CPC ..... *G07F 11/58* (2013.01); *G07F 11/007* (2013.01)
USPC ..... 221/218; 221/253

(58) Field of Classification Search
CPC ..... G07F 11/58; B65G 17/16; B65G 17/42
USPC ..... 221/217, 218, 119, 253, 241; 198/468.2, 468.3, 469.1, 470.1
See application file for complete search history.

(56) References Cited

U.S. PATENT DOCUMENTS 2,923,392 A * 2/1960 Gabrielsen ..... 221/129
3,684,131 A 8/1972 Kurimsky
3,757,993 A * 9/1973 Bruckner et al. ..... 221/80

(Continued)

FOREIGN PATENT DOCUMENTS

GB 1 479 271 7/1977

OTHER PUBLICATIONS

International Search Report dated Aug. 30, 2010.

*Primary Examiner* — Timothy Waggoner
(74) *Attorney, Agent, or Firm* — Hedman & Costigan, P.C.; James V. Costigan; Kathleen A. Costigan

(57) ABSTRACT

A support group (1; 50) of products distributable by means of vending machines comprising a shaped body (2; 51) suitable to be coupled with transport means (6; 75) belonging to the vending machine, the shake body (2; 51) defining an inner seat (3; 52) which receives the product to be supplied and comprising a base plate (4; 53), suitable to be coupled to transport means (6; 75), and a boundary bulkhead (5; 54) removably coupled with the base plate (4; 53) in order to define a plurality of positions of the boundary bulkhead (5; 54) on the base plate (4; 53) varying the dimensions of the inner seat (3; 52) as the type of product to be supplied varies.

10 Claims, 3 Drawing Sheets

(56) References Cited

U.S. PATENT DOCUMENTS 4,582,193 A * 4/1986 Larsson ..... 198/867.15
5,141,128 A * 8/1992 Pippin ..... 221/253
5,255,773 A * 10/1993 Pollock ..... 198/347.3
5,337,887 A * 8/1994 Greenwell et al. ..... 198/867.14
6,598,732 B2 * 7/2003 Guindulain Vidondo .... 198/728

* cited by examiner

SUPPORT GROUP OF PRODUCTS DISTRIBUTABLE BY MEANS OF VENDING MACHINES AND SUPPLY DEVICE OF PRODUCTS USING SUCH A SUPPORT GROUP

The present invention relates to a support group of products, such as edible goods or durable goods of various kinds, contained in automatic vending machines through which they can be supplied to the user.

The invention described herein also refers to a supply device of products, mounted in these automatic vending machines, using the aforesaid support group.

As known, automatic vending machines for rental and sale of durable goods, such as books, videotapes, CDs, DVDs and the like, and/or sale of edible products, such as sweet and salt snacks, sweets, sandwiches, ice creams, beverages of various kinds or the sale of products such as cigarettes, instant lottery tickets or coupons and even more, are currently widespread.

Specifically, these automatic vending machines of the known type include a store, arranged in several housing rows or lanes, located at different height levels or shelves, at each of which they are also side by side.

The products to be supplied are positioned within a plurality of support seats defined in each of the housing lanes according to conformations capable to receive a wide range of products or goods which differ each other for shape and packaging.

If the products are intended to the final supply, such as the edible goods, the automatic vending machines are provided with a transparent front shutter, coupled in a rotating way with the box casing containing the store, in order to allow end user to view the products available and thereby perform his own choice.

Each housing lane or even, in certain constructive solutions, each single support seat defined in the store of such vending machines is, moreover, marked with an alphanumeric code which the user types on a dedicated control panel, externally applied to the box casing so as to make the desired choice, of course after having paid the relative amount.

Upon selection by the user, the products aligned within the lanes are moved, for a given stretch, through transport means towards the transparent front shutter, so that the first product of the selected lane is released, usually by gravity, into a collection chamber made inside the box casing and to which the user approaches by moving a safety door, provided below the shutter and which normally closes the inlet of the collection chamber.

During the withdrawal of the good chosen, the safety door prevents also the unlawful removal of the products from the display store.

If, instead, the products are intended to sale but mostly the rental, such as durable goods, the automatic vending machine includes also a keyboard and a screen coupled with the box casing in order to be available to the user who uses them for the products choice.

In this case, the products are made available to the user at an outlet through which it is also possible to reintroduce the product previously rented for its restitution, always following the payment of a certain amount or the insertion of a prepaid card from which the amount due is automatically deducted.

Usually, this second type of automatic vending machines include, in lieu of the transport means, hooking means, such as a clamp associated with a truck, which, following the command given by the user from the keyboard, withdraw the desired good from the store and convey it at the outlet, if the user is renting or buying a product, or vice versa if the user is returning the rented product.

Regardless the type of supply mechanism adopted in the distributor, the housing lanes which form the store, however include each a support group, in which a series of inner seats is defined which receive the products to be dispensed, and transport means, with which the support group is operatively associated, responsible for advancing the products contained in the lane chosen by the user to cause the release of the first of them.

The support group currently presents various constructive compositions, determined according to the choices made during project.

In accordance with a first embodiment today widespread the support group of each housing lane comprises a base plate, on which the products themselves are supported, while the transport means include a longitudinal spiroid body, defining the inner seats which receive the products, put in rotation by motorization means to move ahead of a default pitch the lane of products themselves on the choice made by the user.

Other embodiments of the support groups of the known type include a motorized conveyor belt which also acts, therefore, as transport system of the products.

However, due to the geometric shape of the packaging of the products and/or the inner seats where they are housed, the pressure exerted by the spiroid body or the conveyor belt once the choice by the customer has been made is not sufficient to cause the fall of the products into the collection chamber and the same remain in the balance on the front edge of the lane.

In addition, the support groups described, used in automatic vending machines, are not suit to contain any kind of products, even widely different each other for shape, size, packaging and use destination, thus not allowing to fully satisfy the requirement, rather widespread and felt by the operators of the market here considered, of providing automatic vending machines which, the capacity being equal, are suitable to supply an increasingly various range of products.

These drawbacks have been partly overcome by the use of automatic vending machines provided for each housing lane with support groups comprising a plurality of shaped elements, coupled with the transport means suit to translate the products, along the different longitudinal directions, in order to make them available to the user at the collection chamber.

Each of the shaped elements, arranged one consecutive to the other along the different longitudinal directions defined by the respective housing lanes of the products, includes a monolithic laminar body having a U-shape or C-shape, L-shape and flat applied through hooking means to the transport means, typically a chain of transmission.

In this way, by aligning one after the other in proper manner the aforesaid shaped elements, it is possible to define for each housing lane inner seats capable of receiving the goods to be dispensed through automatic vending machines equipped with store.

In particular, each of these housing lanes may have a plurality of inner seats equal each other but different from the inner seats defined by one or more of the adjacent housing lanes of the store contained inside the box casing of the vending machine, or may present a plurality of inner seats different each other: this depending on the applications and commercial requirements of the customers faced from time to time by the manufacturer.

It is obvious that the support groups so obtained allow to accept a wide range of products different each other in respect of shape, size, packaging and end use, which can be supplied through automatic vending machines.

In any case, the support groups of the known type just mentioned have some recognized drawbacks.

The main drawback of these support groups consists in the fact that, in order to change the shape of the inner seats in a given operative situation suitable to the containment of the products, with the aim of adapting it to that one of other products of different type, it is necessary to disassemble the individual shaped bodies mentioned above from the transport means and, then, replace them with new shaped bodies suitable to the purpose.

This complicates and lengthens beyond measure the operations which the operator must perform to change the format of the shaped bodies which form the support group.

Another drawback of the support groups of the known art closest to the technical field of the present invention is constituted by the fact that it is necessary to provide and manage a high number of shaped bodies in order to make support groups versatile and universal, that is capable of changing the configuration as the products which can be distributed by vending machines vary.

The present invention seeks to overcome the drawbacks of the known art just complained.

In particular, it is primary purpose of the invention to make available a support group of products distributable by means of vending machines which can be adapted to the support of a broad range of products which differ each other for shape, sizes, packaging and use destination more practically and easily than the current state of the art.

In other words, it is main purpose of the present invention to provide a support group of products distributable by means of vending machines, as well as a supply device of products using such a support group, which allow to simplify and shorten the operations to be performed to change the sizes of the inner seats of housing of the products to be supplied as the type of products varies.

It is a further purpose of the present invention to devise a support group of products distributable by means of vending machines and a supply device of products using such a support group suit to receive and effectively move a range of products to be supplied to the user, even profoundly different each other about the use field, broader than that one handled by equivalent units of known type.

It is a last but not least purpose of the invention to create a support group of products distributable by means of vending machines which allows to achieve the previous purposes using a number of components and, consequently, article codes lower than those ones of the known art.

These purposes are achieved through a support group of products distributable by means of vending machines according to the attached claim 1, to which they refer for brevity.

Further technical features of detail of the support group of the invention are set forth in the corresponding dependent claims.

Integral part of the invention is also a supply device of products, which helps to achieve the purposes mentioned above.

Other structural details of the supply device of the invention are provided in the relative dependent claims.

Advantageously, the support group of products of the invention allows to significantly reduce over the prior art execution laboriousness and times of the operations needed to adapt it to the various types of products which from time to time the operator decides to place inside a vending machine in order to make them available to customers.

The versatility of the support group of the invention, indeed, is reached simply by changing the position of the boundary bulkhead on the base plate which, even during format change operations of the inner seats in order to accept new products to be dispensed, remains fixed and firmly coupled with the transport means, usually a chain loop closed on a pair of gears of transmission spaced apart each other of a given distance.

Still advantageously, the support group of products distributable by means of vending machines and the supply device of products using such a support, both object of the present invention, allow to insert into the store of the machines themselves, and therefore to make available to the supply, a wide range of products also completely different each other for the intended use.

Equally advantageously, the invention reduces compared to the current state of the art of the field in exam the number of components and articles codes which it is necessary to provide to effectively make universal, i.e. suitable to receive any type of product, a support group of products distributable by means of vending machines.

Such an aspect depends on the fact that, in the invention, the versatility of the support group is achieved only by the use of two pieces, the base plate which supports the products to be supplied and the boundary bulkhead removably coupled with it, contrary to the known technique in which the pieces needed for this purpose is larger, including at least three U-shaped, L-shaped and flat elements.

Said purposes and advantages, as well as others that will be better highlighted further on, will appear to a greater extent by the following description related to a preferred embodiment of the support group and the supply device of the invention, given by indicative but not limiting way with reference to the attached drawings where:

The support group of the invention is shown in FIGS. 1*a* and 1*b* in which it is globally numbered with 1.

It is particularly suitable to be installed in automatic vending machines in order to create housing seats of edible products and/or durable goods to be dispensed to the end user.

It is observed that the support group 1 includes, in this case, a plurality of shaped bodies 2 coupled with transport means, overall numbered with 6 and belonging to the vending machine, not shown for ease of exposition.

Figure 2:
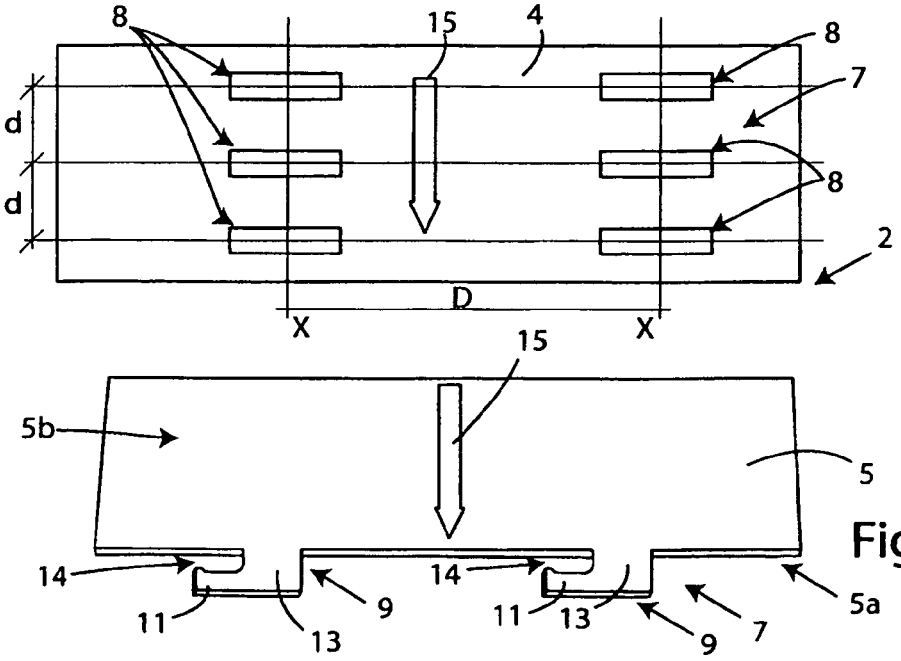
FIG. 2 is the exploded view of two components of the support group of FIG. 1.

Always for the sake of exposition simplicity, FIG. 2 shows only two of the shaped bodies 2 normally coupled with the transport means 6, while being understood that their number, depending on construction choices, is usually higher.

The shaped bodies 2 define an inner seat 3 in which the operator places the products to be supplied.

In accordance with the invention, each of the shaped bodies 2 includes a base plate 4, suitable to be coupled with the transport means 6, and a boundary bulkhead 5, removably coupled with the base plate 4 in order to define a plurality of positions of the boundary bulkhead 5 on the respective base plate 4 by varying the sizes of the inner seat 3 as the type of products to be supplied varies.

In this case, therefore, the inner seat 3 is defined by two shaped bodies 2, resulting interposed between the boundary bulkhead 5 of a first base plate 4 and the boundary bulkhead 5 of the adjacent base plate 4.

Both the base plate 4 and the boundary bulkhead 5 consist of a laminar element made for example of plastic material or stainless steel and which in plan view presents a substantially rectangular profile.

In cross section, instead, the boundary bulkhead 5 presents a rectangular regular profile, while the base plate 4 presents an irregular profile formed by a first rectangular section and a second substantially triangular section which determines as a whole a wedge-shaped profile.

Figure 1:
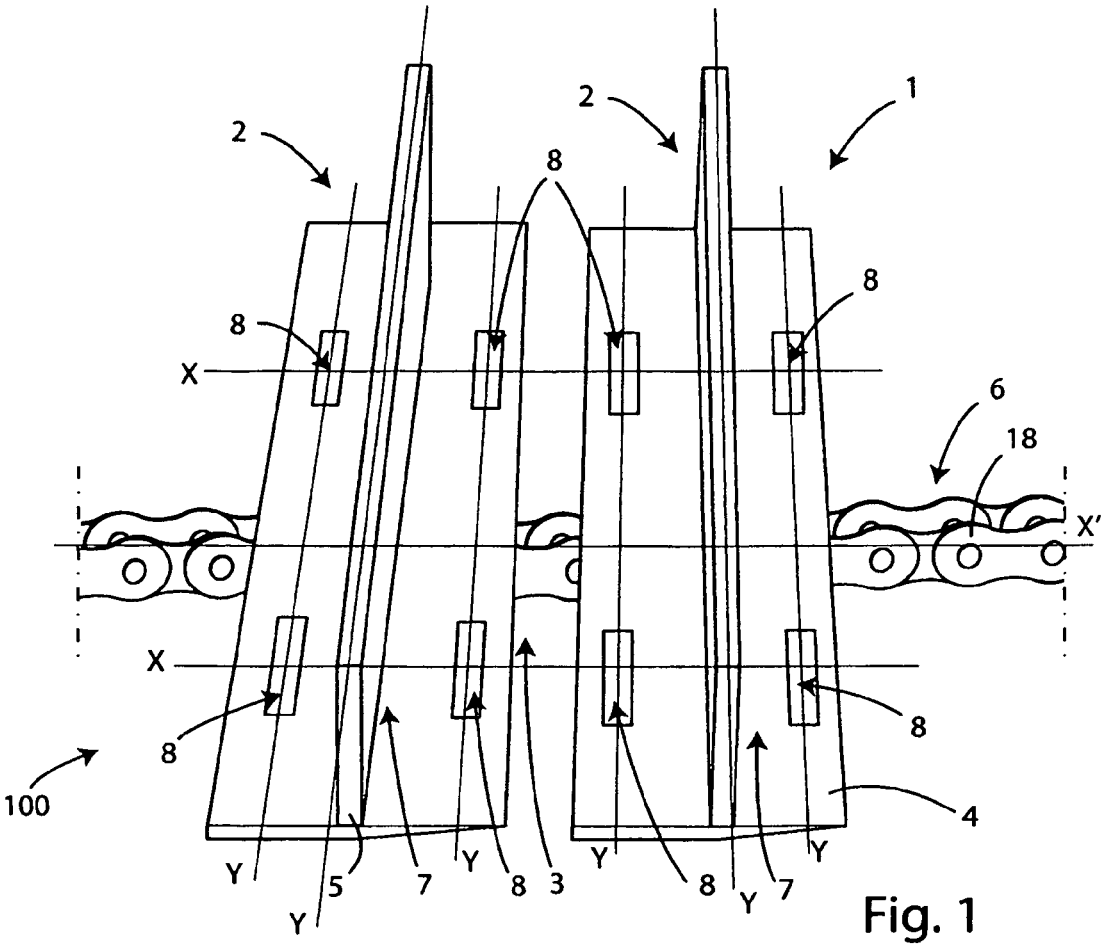
FIG. 1 is a perspective view of the supply device of the invention completed with the support group of the invention.

FIG. 1 shows that, in particular, the boundary bulkhead 5 defines a plane orthogonal to the plane defined by the base plate 4.

The boundary bulkhead 5 is coupled with the respective base plate 4 through adjustment means, indicated overall with 7, visible in more detail in FIG. 2.

According to the preferred embodiment here described of the invention, the adjustment means 7 include:

- a plurality of through slits 8 made on the base plate 4, aligned each other along three main linear directions Y one parallel to the other and along two secondary linear directions X parallel each other and perpendicular to the main directions Y: the main directions Y are separated one from another by a first distance "d" and the secondary directions X are separated one from another by a second distance "D", as clearly highlighted in FIG. 2;
- a plurality of shaped teeth 9, protruding from the perimetrical edge 5*a* of the boundary bulkhead 5, each of which is inserted into the through slits 8 belonging to one of the main linear directions Y to firmly couple with the base plate 4 through joint means, overall reported with 10.

In this case, at pure example title, the shaped teeth 9 of the two boundary bulkheads 5 are inserted into the through slits 8 present along the central main linear direction Y of the respective base plates 4.

Furthermore, the through slits 8 defined along the main linear direction Y and, consequently, the shaped teeth 9 of the boundary bulkhead 5 are, preferably, in the number of two.

It is understood that in other embodiments of the support group of the invention, not shown in the attached drawings, the number of through slits and shaped teeth could be different from that one just indicated, from which it follows that the through slits could be aligned each other along more than two secondary linear directions.

Moreover, other embodiments may exist of the support group of the invention, not represented, in which the through slits are aligned each other along only two main linear directions or along more than three main linear directions.

Figure 3:
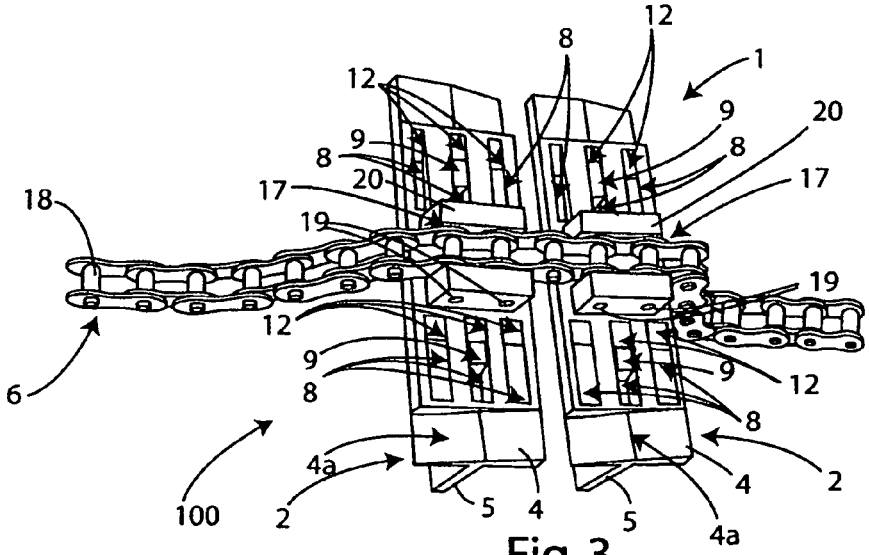
FIG. 3 is the inverted perspective view of FIG. 1.

As far ad the joint means 10 are concerned, preferably but not necessarily, they include an operative appendix 11, arranged in each of the shaped teeth 9, and a surface notch 12, shown in FIG. 3, where the operative appendix 11 is snap-fitted, exploiting the inherent elasticity features.

The surface notch 12 is made in a side face 4*a* of the base plate 4, adjacent to each of the through slits 8 of each of the main linear directions Y.

More in detail, the operative appendix 11 and the main portion 13 of each of the shaped teeth 9 and the perimetrical edge 5*a* of the boundary bulkhead 5 define a strike inlet 14 which receives a limited portion, not shown, of the base plate 4.

FIG. 2 shows also the presence of a first channeled arrow 15, made on the side face 4*b* of the base plate 4, and a second channeled arrow 16, made on the lateral surface 5*b* of the boundary bulkhead 5, useful to indicate to the operator the sense of application of the boundary bulkhead 5 to the base plate 4, thereby further facilitating his processing mode.

Figure 4:
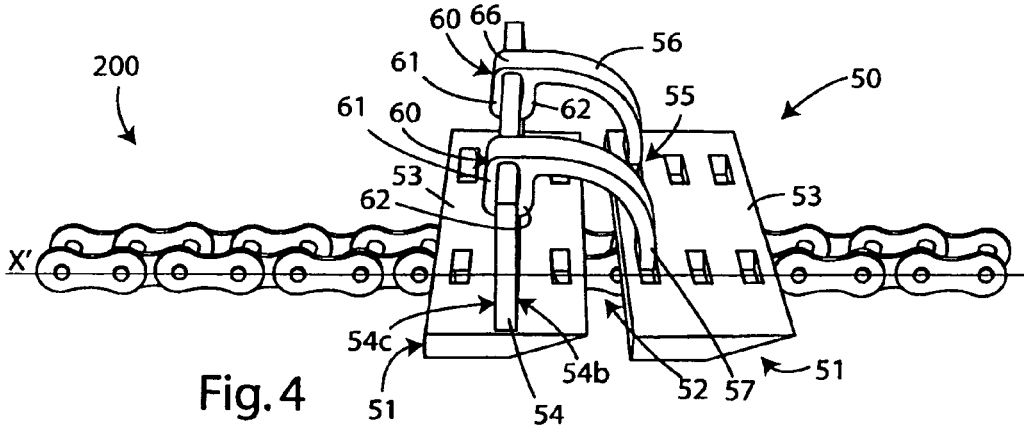
FIG. 4 is a partial and simplified perspective view of the supply device of the invention completed with a first executive variant of the support group of FIG. 1.

FIG. 4 illustrates a possible execution variant of the invention in which the support group, now globally numbered with 50, differs from that one previously described because it comprises holding means, on the whole indicated with 55, removably coupled with the boundary bulkhead 54 and contained in the inner seat 52 defined by the base plate 53 and by the boundary bulkhead 54.

The holding means 55 interfere with the products in the inner seat 52 so as to increase the stability of the products placed on the shaped bodies 51, thus constituting a safety against accidental fall of the products, for example while supplying the product chosen by the user.

In a preferred but non-binding way, the holding means 55 include a pair of elastically yielding curved arms 56, 57, contained in the inner seat 52 defined by the shaped bodies 51.

Figure 5:
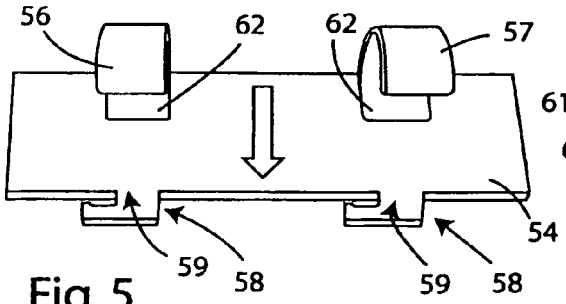
FIG. 5 is a partial perspective view of an enlarged particular of FIG. 4.

As it can be derived from FIG. 5, each of the curved arms 56, 57 is removably coupled with the boundary bulkhead 54 from the opposite side with respect to the shaped teeth 59 of the adjustment means, overall indicated with 58.

In particular, each of the curved arms 56, 57 presents in side view a substantially C-shaped profile and is removably coupled with the boundary bulkhead 54 through union means, as a whole reported 60.

Figure 6:
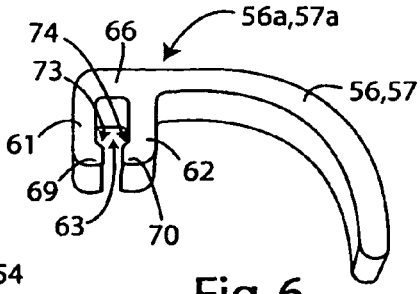
FIG. 6 is a perspective view of a first enlarged particular of FIGS. 4 and 5.
Figure 7:
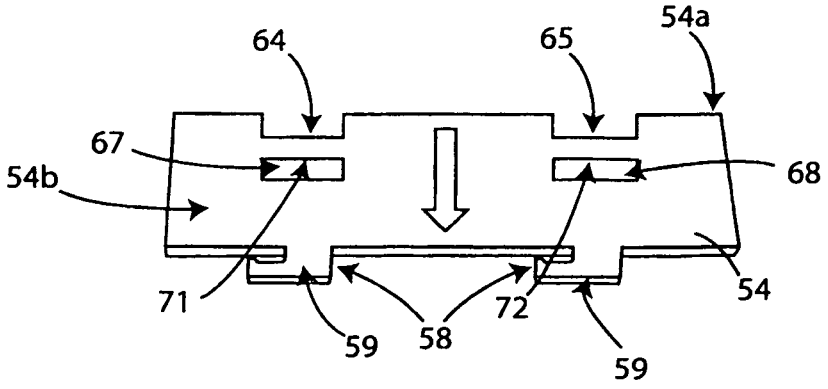
FIG. 7 is the side view of a second particular of FIGS. 4 and 5.

Mainly, the union means 60 include:

- a pair of elastically yielding shaped jaws 61, 62, well visible from the enlargement of FIG. 6, protruding from a first end 56*a*, 57*a* of each of the curved arms 56, 57 and arranged spaced apart and facing each other in order to define an intermediate channel 63 communicating with the outside;
- a pair of perimetrical recesses 64, 65 made in the perimetrical edge 54*a* of the boundary bulkhead 54 from the opposite side with respect to the shaped teeth 59, each of these perimetrical recesses 64, 65 communicating with the intermediate channel 63 to accommodate a narrow section 66 of one of the curved arms 56, 57: in this way the narrow section 66 separates each other the shaped jaws 61, 62;
- a pair of surface grooves made one symmetrically to the other in the side faces 54*b*, 54*c* of the boundary bulkhead 54, below each of the perimetrical recesses 64, 65: in FIG. 7 the surface grooves 67, 68 of the sole side face 54*b* of the boundary bulkhead 54 are visible;
- a pair of rounded protrusions 69, 70, one for each of the aforesaid shaped jaws 61, 62, as it can be noted in FIG. 6, arranged one facing to the other at the free end of the shaped jaws 61, 62 themselves in order to restrict in such a section the intermediate channel 63 and coupled with the surface grooves 67, 68 through hooking means.

More specifically, the hooking means include a linear undercut 71, 72, shown in FIG. 7, of the side wall which delimits each of the surface grooves 67, 68, and an upper stretch 73, 74 of the lateral surface of each of the rounded protrusions 69, 70 of the shaped jaws 61, 62.

The upper stretch 73 of the shape jaw 61 of each of the curved arms 56, 57 cooperates by contact with the linear undercut 71 of surface groove 67 of the side faces 54*b*, 54*c* of the boundary bulkhead 54.

In turn, the upper stretch 74 of the shaped jaw 62 of each of the shaped curved arms 56, 57 cooperates with the linear undercut 72 of the surface groove 68 of the side faces 54*b*, 54*c* of the boundary bulkhead 54.

As mentioned, also the supply device of products installed on vending machines is object of the present invention.

Figure 8:
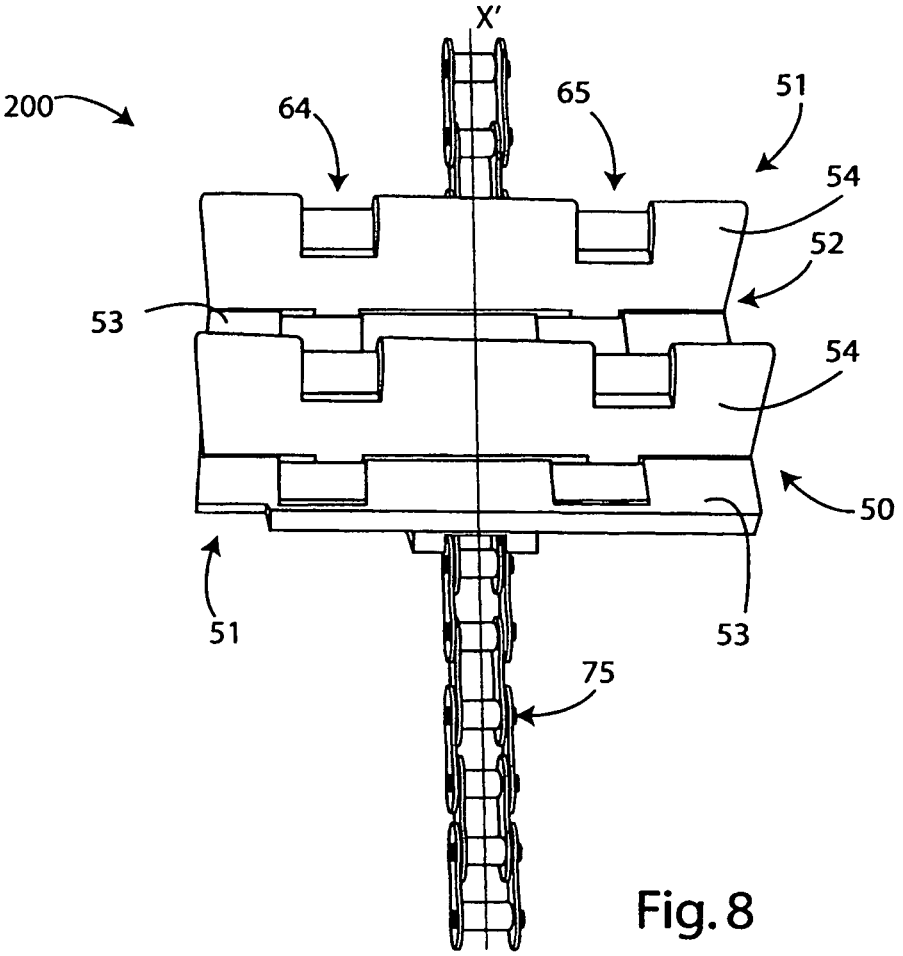
FIG. 8 is a simplified perspective view of the supply device of FIG. 4.

In particular, in the present description, the supply device is shown in a first embodiment in FIGS. 1 and 3, where it is as a whole indicated with 100, and in a second embodiment in FIGS. 4 and 8 where it is globally numbered with 200.

The supply device 100 comprises:

transport means, overall indicated with 6 and operatively connected with motorization means, not shown for simplicity, suitable to selectively cause the advancement of the products to be supplied along at least a longitudinal direction X';

a support group 1 which includes a series of shaped bodies 2 coupled with the transport means 6 in order to define a plurality of inner seats 3 which accept the products to be supplied.

According to the invention, each of the shaped bodies 2 is of the type previously described with reference to FIGS. 1 to 3 and comprises a base plate 4, coupled with the transport means 6, through restraint means, as a whole indicated with 17, and a boundary bulkhead 5 removably coupled with the base plate 4 in order to define a plurality of positions of the boundary bulkhead 5 on the base plate 4 by varying the size of the inner seats 3 as the type of product to be supplied varies.

In this case, the base plates 4 are equal each other and aligned along the longitudinal direction X', while the boundary bulkheads 5 are coupled with said base plates 4 in order to define along the longitudinal direction X' a plurality of inner seats 3.

More precisely, each of the inner seats 3 is defined by a first base plate 4 and two boundary bulkheads 5, one of which is coupled with the aforesaid first base plate 4 and the other one with a base plate 4 adjacent to the first plate 4.

Preferably but not necessarily, the transport means 6 include at least one chain 18 which engages on appropriate transmission sprockets spaced apart each other, not visible in the appended figures.

The restraint means 17 include for example a pair of pins 19 inserted into through holes, not visible, made in a connecting block 20, protruding from the side face 4*a* of the base plate 4, and into through opening, coaxial to the through holes of the connecting block, present in the chain 18.

Operatively, the base plates 4 equal each other are coupled through the restraint means 17 with the transport means 6 one consecutively aligned to another, usually along several housing lanes of the store of the products vending machine.

Subsequently, the operator applies the boundary bulkheads 5 to the base plates 4, by insertion of the shaped teeth 9 of the first into the through slits 8 of the latter, thus defining the inner seats 3 suitable to receive the products to be supplied and completing the construction of the supply device 1.

The application of the various boundary bulkheads 5 takes place according to a very precise logic which depends primarily on the type of products to be supplied positioned in the inner seats 3.

In this connection, operative conditions could exist in which at least one inner seat 3 is defined on the same base plate 4 by two boundary bulkheads 5 mutually spaced apart and parallel, applied to the base plate 4 itself.

In other operative situations, instead, at least one inner seat 3 could be included between two base plates 4 one consecutive and aligned to the other, defined by two boundary bulkheads 5 applied one to a first base plate 4 and the other one to the nearest base plate 4.

If the operator, due to occurred requirements, intends to put other products in the support group 1, each of which differs for shape, sizes and/or packaging from those ones previously housed in order to make them available to the supply to the user, he simply has to leave one or more boundary bulkheads 5 by the coupling with the respective base plates 4 and, exploiting the adjustment means 7, change their position on the base plates 4.

In this way, the operator changes in very short times the dimensions of the inner seats 3, making them suited to receive the new products to be supplied, without, however, acting at all on the base plates 4 which remain always fixed in the position of coupling with the chain 18 of the transport means 6.

Compared to the known prior art, therefore, the advantage brought by the present invention seems to be relevant and immediate to catch: the support group 1 allows, indeed, to change the size of the inner seats 3 as the type of product which must be received on them varies in a way greatly easier and faster than the support groups of the known type.

The standard shape of the base plates 4, suitable for any operative situation, then determines a reduction of the components to be produced and the article codes to be managed obtaining for the producer advantages of considerable significance which could likely reflect in a cost of the finished product lower than the equivalent known technique, all the factors involved in the calculation being equal.

It is understood that what just said for the supply device 100 is completely valid and applicable also for the supply device 200 which includes the transport means 75 and the support group 50 previously described with reference to FIGS. 4-8.

The preparation of the supply device 200 provides, in fact, all the operations described above carried out in order to obtain the supply device 100, with the only variation of coupling with the boundary bulkheads 54 the holding means 55 in order to increase the stability of the products to be supplied to the user which are positioned into the inner seats 52.

On the basis of what exposed above, it is understood, therefore, that the support group of products distributable by means of vending machines, as well as the supply device using such a support group, both object of the present invention, achieve the purposes and reach the advantages already mentioned.

In execution phase, changes could be made to the supply device of the invention consisting, for example, in the provision of a single shaped body comprising a base plate and a pair of boundary bulkheads removably coupled with it in order to define a single inner seat suitable to accept the products to be supplied.

Moreover, in other embodiments of the invention each of the shaped bodies of the supply device may include a pair of boundary bulkheads coupled with the base plate in order to define various reciprocal positions as the type of products to be supported varies.

It is stated precisely that the supply device of products of the invention used in vending machines may include any number of support groups for each housing seat of the store contained inside the box casing of the machine itself.

Moreover, in other embodiments the supply device of the invention may include transport means different from those ones described and illustrated in the figures that follow, which does not affect the advantages brought by the present invention.

It is clear that numerous other variations may be made to the support group and the supply device in question, without for this reason going out of the novelty principles inherent to the inventive idea here expressed, as it is clear that, in the practical implementation of the invention, materials, shapes and sizes of the details illustrated can be any, as needed, and replaced with others technically equivalent.

Where the features and techniques mentioned in the subsequent claims are followed by reference signs, such reference signs have been introduced with the sole objective of increasing the intelligibility of the claims themselves and, consequently, these reference signs do not have any limiting effect on the interpretation of each element identified, by way of example only, by these reference signs.

The invention claimed is:

1. A support group (1; 50) for products distributable by means of vending machines comprising a plurality of shaped bodies (2; 51) suitable to be coupled with transport means (6; 75) belonging to said vending machine, at least one of said shaped bodies (2; 51) defining an inner seat (3; 52) suitable to accept said products to be supplied characterized in that at least one of said shaped bodies (2; 51) comprises a base plate (4; 53), suitable to be coupled with said transport means (6; 75) and support said products, and at least one boundary bulkhead (5; 54) removably coupled with said base plate (4; 53) in order to define a plurality of positions of said boundary bulkhead (5; 54) on said base plate (4; 53) by varying the size of said inner seat (3; 52) along at least one longitudinal horizontal direction (X') as product types vary wherein said boundary bulkhead (5; 54) is coupled with said base plate (4; 53) through adjustment means (7; 58) wherein said adjustment means (7; 58) comprise: a plurality of through slits (8) made on said base plate (4; 53), aligned to each other along at least two main linear directions (Y) that are parallel to each other and along at least two secondary linear directions (X) parallel to each other and perpendicular to said main linear directions (Y), said main linear directions (Y) being separated one from another by a first distance (d) and said secondary linear directions (X) being separated one from another by a second distance (D); and having a plurality of shaped teeth (9; 59), having a main portion (13), said shaped teeth protruding from a perimetrical edge (5*a*) of said boundary bulkhead (5), each of said shaped teeth (9) being inserted into said through slits (8) that are aligned in one of said main linear directions (Y) for firmly coupling with said base plate (4; 53) through joint means (10).

2. The support group (1; 50) as defined in claim 1 characterized in that there are two of said through slits (8) defined along said main linear direction (Y) and there are two of said shaped teeth (9; 59) of said boundary bulkhead (5; 54).

3. The support group (1; 50) as defined in claim 1 characterized in that said support group includes an operative appendix (11), that is arranged in each of said shaped teeth (9; 59), and said base plate (4; 53) having a surface notch (12) that is suitable to house said operative appendix (11), said surface notch (12) being made in a side face (4*a*) of said base plate (4; 53) in a position adjacent to each of said through slits (8).

4. The support group (1; 50) as defined in claim 3 characterized in that said operative appendix (11) and the main portion (13) of each of said shaped teeth (9; 59) and said perimetrical edge (5*a*) of said boundary bulkhead (5; 54) defines a strike inlet (14) which receives a limited portion of said base plate (4; 53).

5. The support group (1; 50) as defined in claim 1 characterized in that said boundary bulkhead (5; 54) defines a plane orthogonal to the plane defined by said base plate (4; 53).

6. A support for products distributable by means of vending machines comprising a plurality of shaped bodies (2; 51) suitable to be coupled with transport means (6; 75) belonging to said vending machine, at least one of said shaped bodies (2; 51) defining an inner seat (3; 52) suitable to accept said products to be supplied characterized in that at least one of said shaped bodies (2; 51) comprises a base plate (4; 53), suitable to be coupled with said transport means (6; 75) and support said products, and at least one boundary bulkhead (5; 54) removably coupled with said base plate (4; 53) in order to define a plurality of positions of said boundary bulkheads (5; 54) on said base plate (4; 53) by varying the size of said inner seat (3; 52) along at least one longitudinal horizontal direction (X') as product vary wherein said boundary bulkhead (5; 54) is coupled with said base plate (4; 53) through adjustment means (7; 58) wherein said support group comprises holding means (55), removably coupled with said boundary bulkhead (54) and contained in said inner seat (52) that is defined by said base plate (53) and said boundary bulkhead (54), said holding means (55) being suitable to hold said products that are placed into said inner seat (52) to increase said products stability when said products are placed on said shaped bodies (51).

7. The support group (50) as defined in claim 6 characterized in that said holding means (55) include a pair of elastically yielding curved arms (56, 57) contained in said inner seat (52) defined by said shaped bodies (51), each of said curved arms (56, 57) being removably coupled with said boundary bulkhead (54) through union means (60).

8. The support group (50) as defined in claim 7 characterized in that said union means (60) comprise: a pair of elastically yielding shaped jaws (61, 62), protruding from a first end (56*a*, 57*a*) of each of said curved arms (56, 57) and arranged spaced apart and facing each other in order to define an intermediate channel (63) communicating with the outside; a pair of perimetrical recesses (64, 65) made on a perimetrical edge (54*a*) of said boundary bulkhead (54) from the opposite side with respect to shaped teeth (59) that protrude from said perimetrical edge (5*a*), each one of said perimetrical recesses (64, 65) communicating with said intermediate channel (63) to accommodate a narrow section (66) of one of said curved arms (61, 62), the narrow section (66) being positioned to separate said shaped jaws (61, 62); a pair of surface grooves (67, 68) that are symmetrical to each other on the side faces of said boundary bulkhead (54) below each of said perimetrical recesses (64, 65); a pair of rounded protrusions (69, 70), one for each of said shaped jaws (61; 62), said pair of rounded protrusions being arranged facing each other at the free end of said shaped jaws (61, 62) in order to restrict said intermediate channel (63) and coupled with said surface grooves (67, 68) through hooking means comprising a linear undercut (71, 72) and an upper stretch (73, 74) of the lateral surface of the pair of rounded protrusions 69, 70).

9. The support group (50) as defined in claim 8 characterized in that said hooking means include a linear undercut (71, 72) of a side wall which delimits each of said surface grooves (67, 68), and an upper stretch (73, 74) of a lateral surface of each of said pair of rounded protrusions (69, 70) which cooperate by contact with said linear undercut (71, 72).

10. The support group (50) as defined in claim 7 characterized in that each of said curved arms (56, 57) presents a substantially C-shaped profile in side view.

* * * * *